US006328020B1

(12) United States Patent
Wada et al.

(10) Patent No.: US 6,328,020 B1
(45) Date of Patent: Dec. 11, 2001

(54) FUEL SUPPLY CONSTRUCTION FOR ENGINES

(75) Inventors: Tetsu Wada; Sadafumi Shidara, both of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/308,675

(22) PCT Filed: Dec. 19, 1997

(86) PCT No.: PCT/JP97/04702

§ 371 Date: Jun. 4, 1999

§ 102(e) Date: Jun. 4, 1999

(87) PCT Pub. No.: WO98/27324

PCT Pub. Date: Jun. 25, 1998

(30) Foreign Application Priority Data

Dec. 19, 1996 (JP) ..... 8-340216

(51) Int. Cl.[7] ..... F02M 33/04
(52) U.S. Cl. ..... 123/509; 123/516
(58) Field of Search ..... 123/509, 514, 123/516, 184.24

(56) References Cited

U.S. PATENT DOCUMENTS 5,555,858 9/1996 Katoh ..... 123/572

FOREIGN PATENT DOCUMENTS 03064658 3/1991 (JP) .
04295172 10/1992 (JP) .
6-117270 4/1994 (JP) .
6-129316 5/1994 (JP) .
07-149290 6/1995 (JP) .
08093603 4/1996 (JP) .
08246974 9/1996 (JP) .
09-280140 10/1997 (JP) .
10-205347 8/1998 (JP) .

*Primary Examiner*—Thomas N. Moulis
(74) *Attorney, Agent, or Firm*—Arent Fox Kintner Plotkin & Kahn, PLLC

(57) ABSTRACT

An intake manifold 85 having integrally a surge tank 82, a plurality of intake pipes 83*a* to 83*d* and a mounting flange 84 is provided at the mounting flange 84 with a plurality of fuel injection valves 94. A subsidiary tank 89 provided therein with a high pressure fuel tank 91 and provided outside thereof with a high pressure filter 93 for temporarily storing a fuel to be supplied to the fuel injection valves 94 is secured to intake pipes 83*c*, 83*d* by means of two bolts 106 and secured to a cylinder block 6 by means of two bolts 107. The high pressure fuel tank 91, the high pressure filter 93 and the subsidiary tank 89 are beforehand assembled to the intake manifold 85 to make a subassembly and the subassembly is collectively assembled to an engine to thereby reduce the number of assembling steps.

9 Claims, 8 Drawing Sheets

FUEL SUPPLY CONSTRUCTION FOR ENGINES

FIELD OF THE INVENTION

The present invention relates to a fuel supply structure in an engine provided with a high-pressure fuel supply means including a subsidiary tank for temporarily storing fuel to be supplied to a fuel injection valve.

BACKGROUND ART

For example, an intake manifold which is a member in an intake system in an engine is mounted to a sidewall of a cylinder head into which an intake port opens, as described in Japanese Patent Application Laid-open No.6-129316. The high-pressure fuel supply means for supplying fuel of a high pressure to the fuel injection valve provided in the intake manifold is mounted to an engine body such as a cylinder block, and the fuel injection valve provided in the intake manifold and the high-pressure fuel supply means are connected to each other by a fuel piping.

The above known engine suffers from the following problems. It is necessary to separately carry out the assembling of the intake manifold in the engine and the assembling of the high-pressure fuel supply means at the time of performing assembling or maintenance of the engine. Moreover, after completion of such assembling, it is necessary to carry out a piping operation for connecting the fuel injection valve provided in the intake manifold and the high-pressure fuel supply means to each other, and hence, a lot of time is required for such operation.

DISCLOSURE OF THE INVENTION

The present invention has been accomplished with the above circumstances in view, and it is an object of the present invention to enhance the operability of assembling of the high-pressure fuel supply means.

To achieve the above object, according to the present invention, there is provided a fuel supply structure in an engine, characterized in that said structure is comprised of a high-pressure fuel supply means which includes a subsidiary tank for temporarily storing fuel to be supplied to a fuel injection valve, the high-pressure fuel supply means being mounted to an intake system having the fuel injection valve provided therein.

With the above arrangement, the high-pressure fuel supply means which includes a subsidiary tank for temporarily storing fuel to be supplied to a fuel injection valve is mounted to the intake system having the fuel injection valve provided therein. Therefore, it is possible to complete the assembling of the intake system and the high-pressure fuel supply means only by mounting a subassembly formed of the high-pressure fuel supply means previously assembled to the intake system to the engine, leading to an enhanced assembling operability. Moreover, the assembling of a fuel piping from the high-pressure fuel supply means to the fuel injection valve can be previously finished in the state of subassembly and hence, the assembling operability is further enhanced.

In addition to the subsidiary tank, the high-pressure fuel supply means may include a high-pressure fuel pump or a high-pressure filter, and may include a surplus fuel returning means for returning a surplus fuel from the fuel injection valve to the subsidiary tank. The high-pressure fuel pump may be accommodated in the subsidiary tank, or mounted to the intake system outside the subsidiary tank. The intake system may be comprised of a surge tank and an intake pipe, and the high-pressure fuel supply means may be mounted to the intake pipe. The intake system may be disposed on one side of a cylinder axis, and an electric equipment box may be disposed on the other side of the cylinder axis.

BRIEF DESCRIPTION OF THE DRAWINGS

FIGS. 1 to 7 show a first embodiment of the present invention.

FIG. 1 is a side view of the entire arrangement of an outboard engine system;

FIG. 2 is an enlarged sectional view taken along a line 2—2 in FIG. 1;

FIG. 3 is a view taken in the direction of an arrow 3 in FIG. 2;

FIG. 4 is a view taken in the direction of an arrow 4 in FIG. 3;

FIG. 6 is a sectional view taken along a line 6—6 in FIG. 3;

FIG. 7 is an enlarged sectional view of an essential portion shown in FIG. 3;

BEST MODE FOR CARRYING OUT THE INVENTION

A mode for carrying out the present invention will now be described by way of a first embodiment shown in FIGS. 1 to 7.

Figure 1:
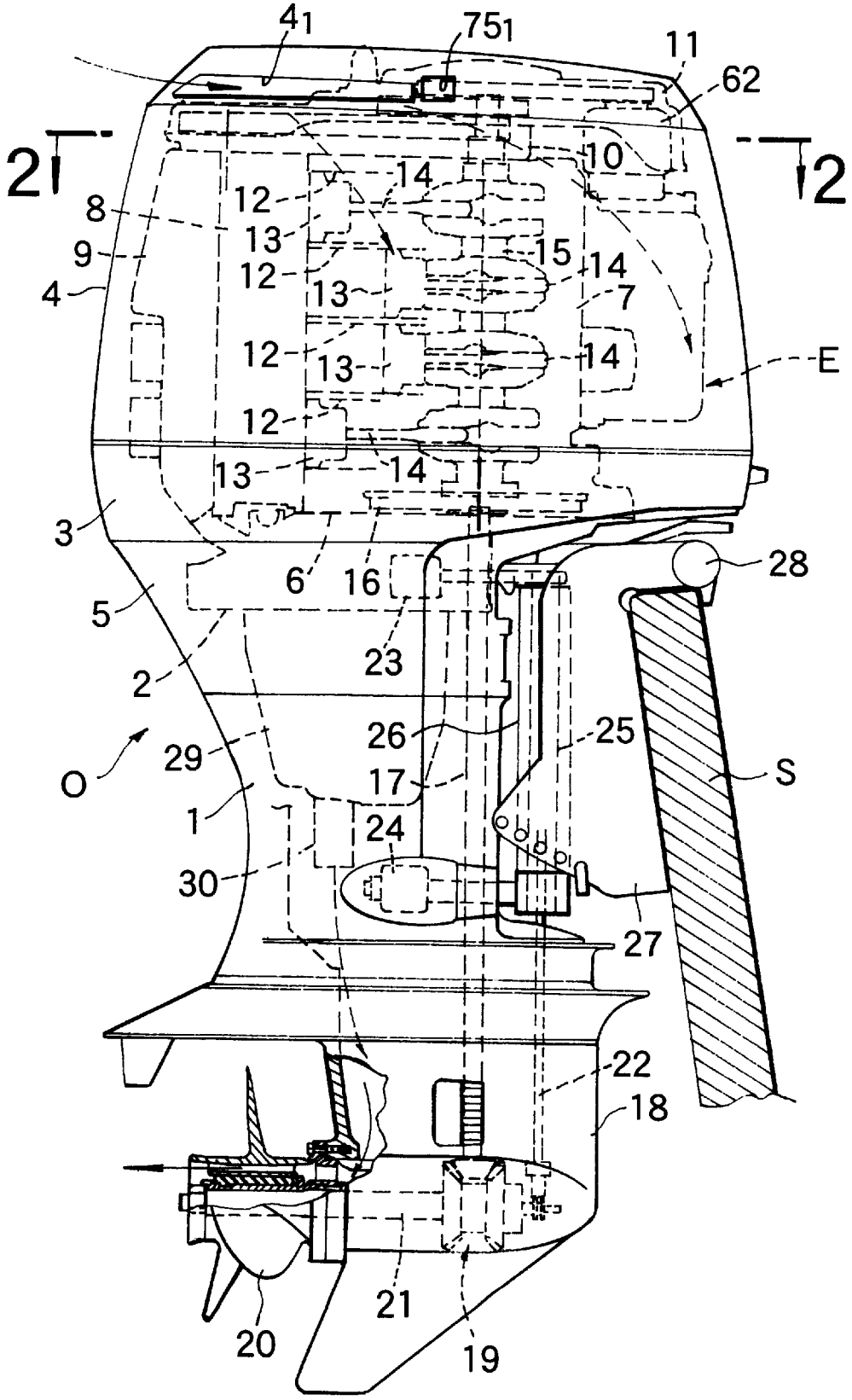

As shown in FIG. 1, an outboard engine system O includes a mount case 2 coupled to an upper portion of an extension case 1. A water-cooled in-line type 4-cylinder and 4-cycle engine E is supported on an upper surface of the mount case 2 with a crankshaft 15 disposed vertically. An under-case 3 having an upper surface opened is coupled to the mount case 2, and an engine cover 4 is detachably mounted on an upper portion of the under-case 3. An under-cover 5 is mounted between a lower edge of the under-case 3 and an edge of the extension case 1 near its upper end so as to cover an outside of the mount case 2.

The engine E includes a cylinder block 6, a crankcase 7, a cylinder head 8, a head cover 9, a lower belt cover 10 and an upper belt cover 11. Lower surfaces of the cylinder block 6 and the crankcase 7 are supported on the upper surface of the mount case 2. Pistons 13 are slidably received in four cylinders 12 defined in the cylinder block 6 and are connected to the crankshaft 15 disposed vertically, through connecting rods 14.

A driving shaft 17 connected to a lower end of the crankshaft 15 along with a flywheel 16 extends downwards within the extension case 1 and is connected at its lower end to a propeller shaft 21 having a propeller 20 at its rear end, through a bevel gear mechanism 19 provided within a gear case 18. A shift rod 22 is connected at its lower end to a front portion of the bevel gear mechanism 19 to change over the direction of rotation of the propeller shaft 21.

A swivel shaft 25 is fixed between an upper mount 23 provided on the mount case 2 and a lower mount 24 provided on the extension case 1. A swivel case 26 for rotatably supporting the swivel shaft 25 is vertically swingably carried on a stern bracket 27 mounted at a stern S through a tilting shaft 28.

An oil pan 29 and an exhaust pipe 30 are coupled to a lower surface of the mount case 2. An exhaust gas discharged from the exhaust pipe 30 into a space within the extension case 1 is discharged through a space within the gear case 18 and the inside of the a boss portion of the propeller 20 into the water.

Figure 2:
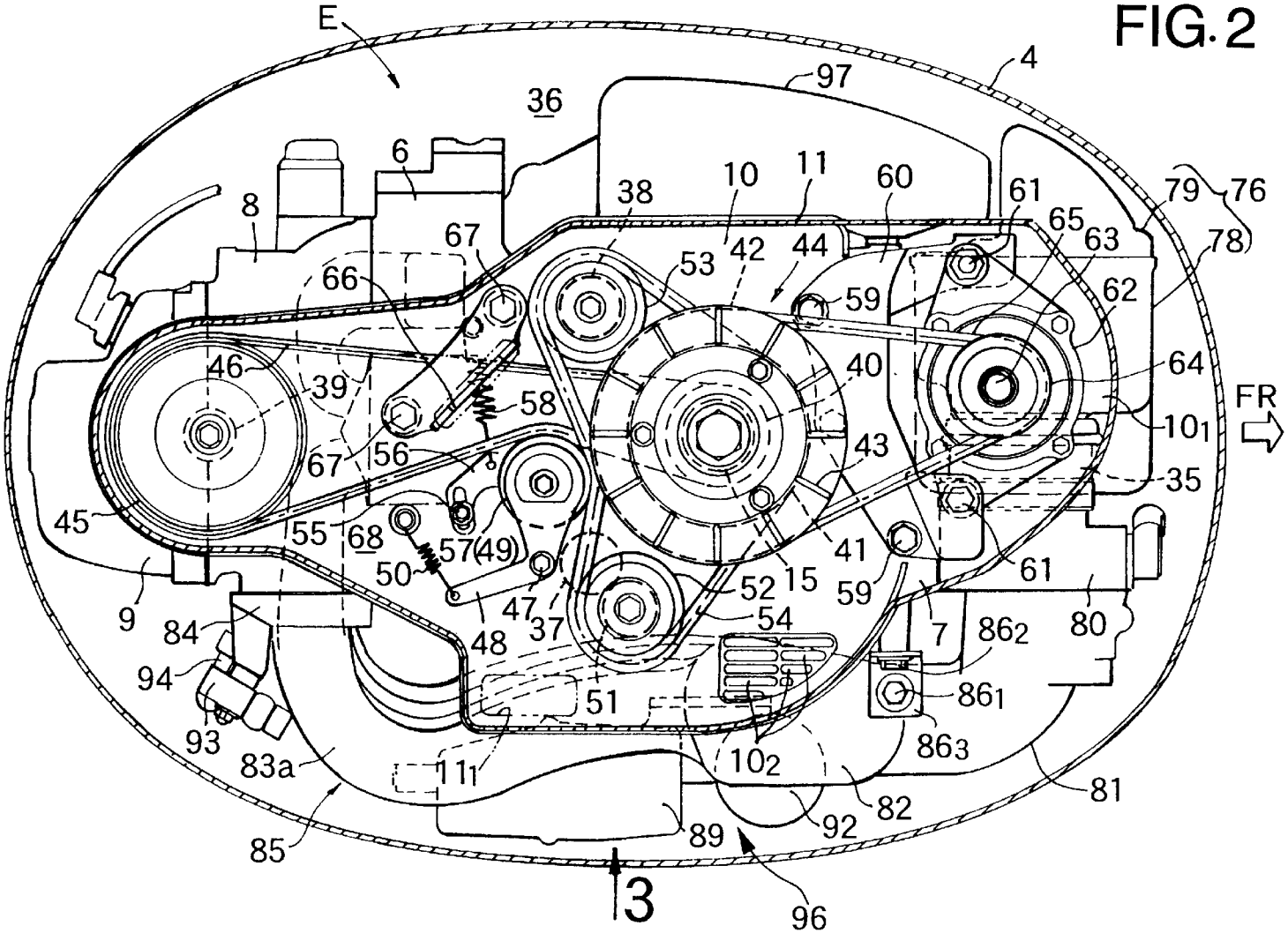

As can be seen from FIG. 2, the engine E accommodated in an engine room 36 defined by the under-case 3 and the engine cover 4 includes two secondary balancer shafts 37 and 38 disposed in parallel to the crankshaft 15, and a single cam shaft 39. The secondary balancer shafts 37 and 38 are supported in the cylinder block 6 at locations nearer the cylinder head 8 than the crankshaft 15, and the cam shaft 39 is supported on mating faces of the cylinder head 8 and the head cover 9.

A pulley assembly 44 is fixed to an upper end of the crankshaft 15 and comprised of a cam shaft drive pulley 40, a secondary balancer shaft drive pulley 41, a generator drive pulley 42 and a cooling fan 43 which are formed integrally with one another. A cam shaft follower pulley 45 fixed to an upper end of the cam shaft 39 and the cam shaft drive pulley 40 are connected to each other by an endless belt 46. The diameter of the cam shaft drive pulley 40 is set at one half of the diameter of the cam shaft follower pulley 45, so that the cam shaft 39 is rotated at a speed which is one half of the speed of the crankshaft 15. A tension pulley 49 mounted at one end of an arm 48 pivotally supported by a pin 47 is urged against an outer surface of the endless belt 46 by the resilient force of a spring 50, thereby providing a predetermined tension to the endless belt 46.

A pair of secondary balancer shaft follower pulleys 52 and 53 are fixed respectively to an intermediate shaft 51 mounted in the vicinity of one of the secondary balancer shaft 37 and to the other secondary balancer shaft 38. The secondary balancer shaft follower pulleys 52 and 53 and the secondary balancer shaft drive pulley 41 are connected to each other by the endless belt 54. A tension pulley 57 is mounted at one end of an arm 56 pivotally supported by a pin 55 and urged against an outer surface of the endless belt 54 by the resilient force of a spring 58, thereby providing a predetermined tension to the endless belt 54. An intermediate shaft 52 and the one secondary balancer shaft 37 are interconnected by a pair of gears (not shown) having the same diameter, and the diameter of the secondary balancer shaft drive pulley 41 is set at two times the diameter of the secondary balancer shaft follower pulleys 52 and 53. Therefore, the pair of secondary balancer shafts 37 and 38 are rotated in opposite directions at a speed two times that of the crankshaft 15.

A generator 62 is supported by two bolts 61, 61 on a bracket 60 which is fixed to an upper surface of the crankcase 7 by two bolts 59, 59. A generator follower pulley 64 fixed to a rotary shaft 63 of the generator 62 and the generator drive pulley 42 are interconnected by the endless belt 65, and the generator 62 is driven by the crankshaft 15. Since the generator 62 is mounted separately from the engine E in the above manner, the general-purpose generator 62 can be used, which is convenient for the cost and moreover, the capacity of the generator 62 can easily be increased, as compared with the case where the generator is incorporated into the flywheel mounted on the crankshaft 15.

An engine hanger 66 engaged by a hook of a chain block or a crane in hanging down the outboard engine system O is fixed by two bolts 67, 67 between the cam shaft 39 and the other secondary balancer shaft 38. The engine hanger 66 is positioned slightly at the rear of the position of the gravity center of the outboard engine system O, and it is taken into consideration that the outboard engine system O hung down by the engine hanger 66 can easily be mounted at and removed from the stern S as a forward-leaned attitude in which the lower end of the outboard engine system has leaped up slightly rearwards.

Three belts 46, 54 and 65 for driving the cam shaft 39, the secondary balancer shafts 37 and 38 and the generator 62 are accommodated in a belt chamber 68 defined by the lower and upper belt covers 10 and 11. The lower belt cover 10 has an opening $\mathbf{10}_1$ surrounding the periphery of the generator 62, and a plurality of slits $\mathbf{10}_2$ in its bottom wall on the right of the crankshaft 15, so that air is introduced into the belt chamber 68 through the opening $\mathbf{10}_1$ and the slits $\mathbf{10}_2$. An upper end of the engine hanger 66 protrudes upwards through the upper belt cover 11.

Figure 3:
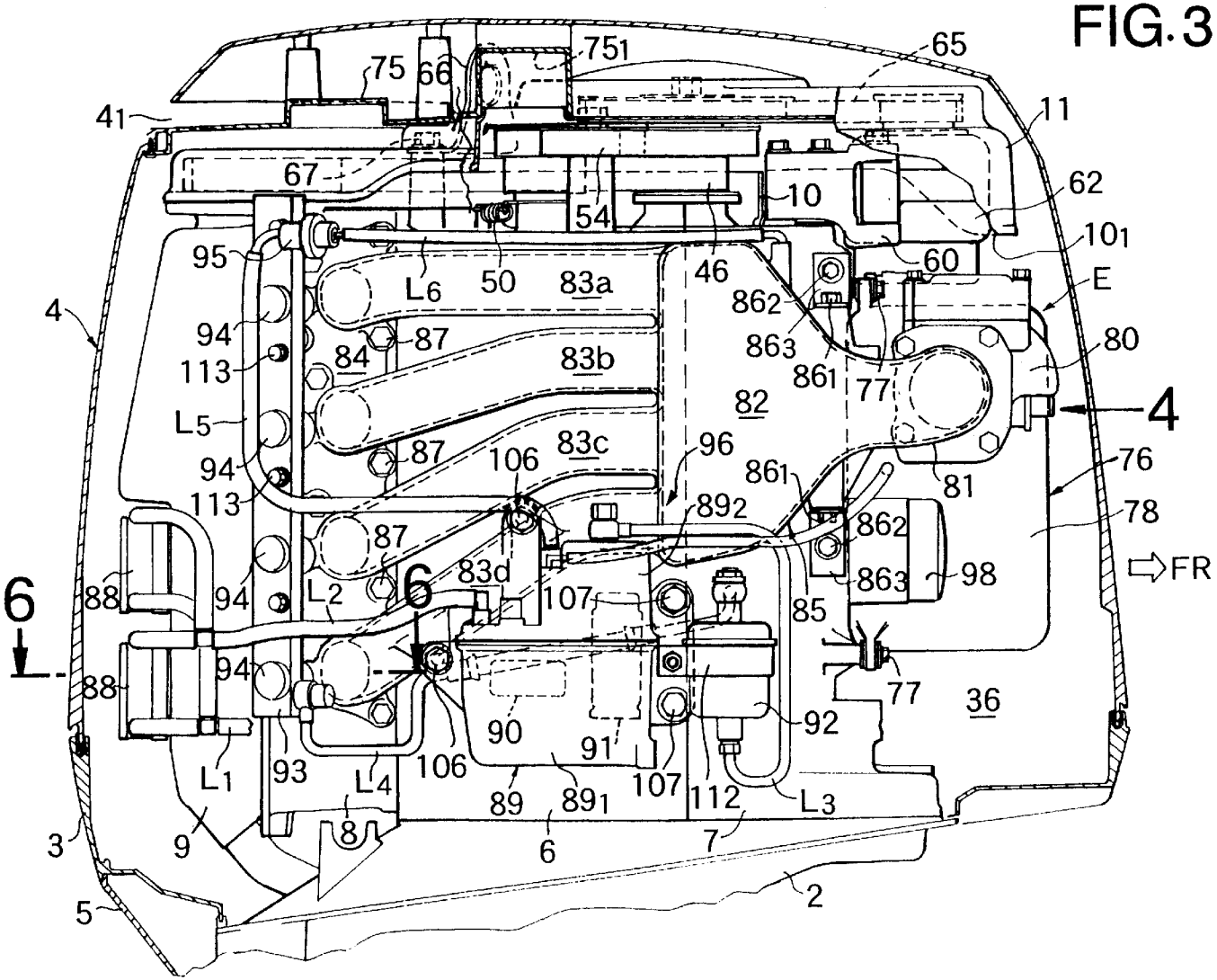
Figure 4:
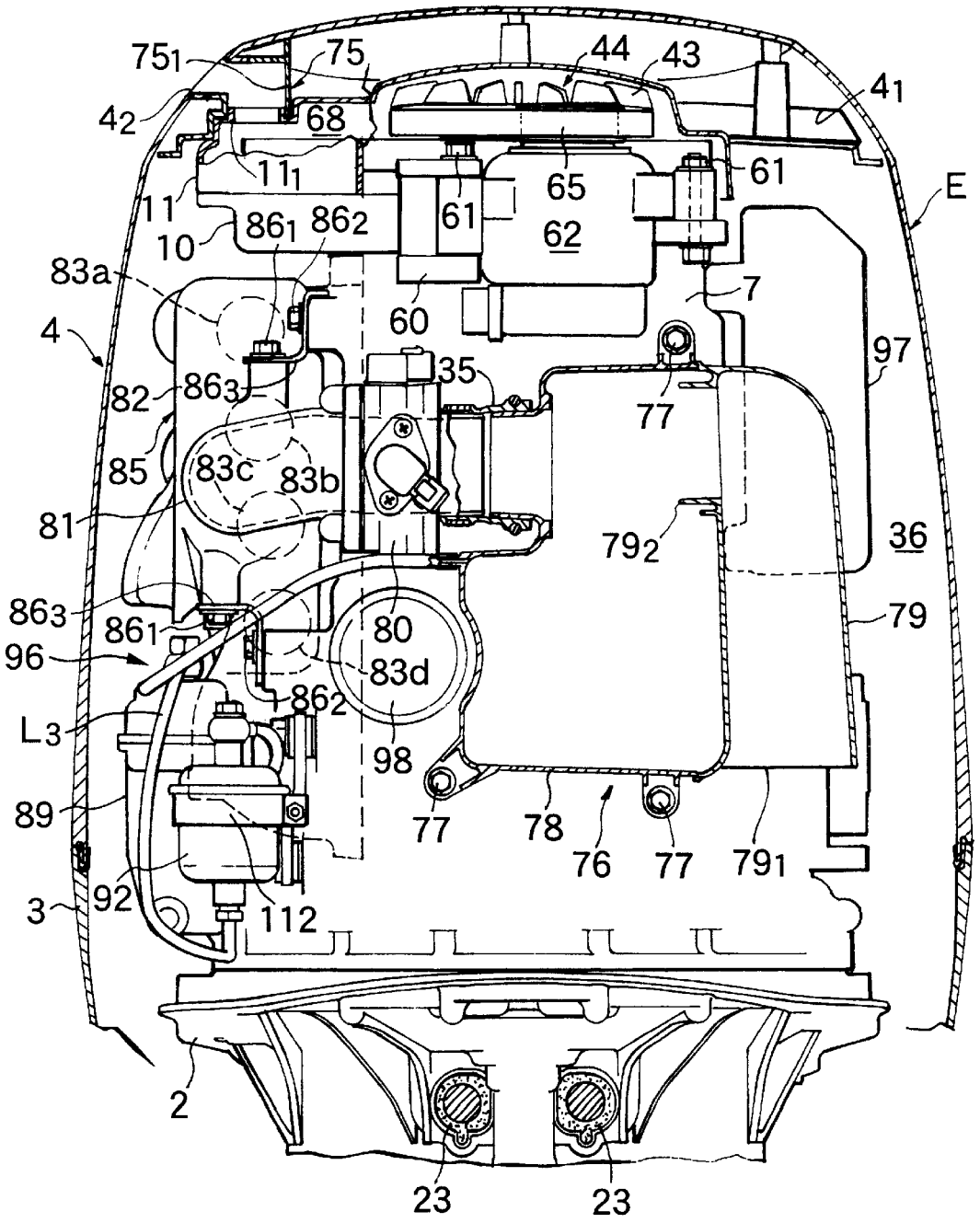

As can be seen from FIGS. 2 to 4, a pair of left and right slit-shaped air intake bores $\mathbf{4}_1$, $\mathbf{4}_1$ are defined in a rear surface of an upper portion of the engine cover 4, and a guide plate 75 extending forwards from lower edges of the air intake bores $\mathbf{4}_1$, $\mathbf{4}_1$ is fixed to an inner surface of the engine cover 4. Therefore, air drawn from the air intake bores $\mathbf{4}_1$, $\mathbf{4}_1$ flows forwards through a space defined between an upper wall of the engine cover 4 and the guide plate 75 to enter the engine room 36 from a front edge of the guide plate 75. A ventilating duct $\mathbf{75}_1$ (see FIG. 4) is formed in a right side of the guide plate 75, so that its lower end communicates with an opening $\mathbf{11}_1$ defined in a right side of the upper belt cover 11 and its upper end communicates with an opening $\mathbf{4}_2$ defined in a right side of the upper portion of the engine cover 4. The ventilating duct $\mathbf{75}_1$ permits the belt chamber 68 surrounded by the lower and upper belt covers 10 and 11 to be put into communication with the open air, thereby performing the ventilation.

The structure of an intake system of the engine E will be described below with reference to FIGS. 2 to 5D.

An intake silencer 76 is fixed to a front surface of the crankcase 7 by three bolts 77. The intake silencer 76 comprises a box-shaped body portion 78, and a duct portion 79 coupled to a left side of the body portion 78. The duct portion 79 has an intake opening $\mathbf{79}_1$ provided downwards in its lower end, and a communication bore $\mathbf{79}_2$ provided in its upper end to communicate with an internal space in the body portion 78. A throttle body 80 is disposed in a right side of the body portion 78 of the intake silencer 76 and connected to the body portion 78 through a short intake duct 35 having flexibility.

The throttle body 80 is connected and fixed to an intake manifold 85 which will be described below. The intake manifold 85 is disposed to extend along a right side of the engine E and is integrally provided with an elbow 81, a surge tank 82, four intake pipes 83*a*, 83*b*, 83*c* and 83*d* and a mounting flange 84. The elbow 81 serves to change the flow of intake air by approximately 90° from the flow along the front surface of the crankcase 7 to the flow along a right side of the crankcase 7. The elbow 81 may be a duct having flexibility, but is integral with the surge tank 82, the intake pipes 83*a*, 83*b*, 83*c* and 83*d* and the mounting flange 84 in order to support and fix the throttle body 80 in this embodiment.

A connecting portion between the elbow 81 and the surge tank 82 of the intake manifold 85 has a size vertically smaller than upper and lower ends of the surge tank 82. The intake manifold 85 is fixed at this portion to a right sidewall of the crankcase 7 by bolts $\mathbf{86}_1$, $\mathbf{86}_1$; $\mathbf{86}_2$, $\mathbf{86}_2$ and two brackets $86_3$, $86_3$ having loose bores. Further, the mounting flange 84 is fixed to an intake manifold mounting surface $8_1$ formed on a right side of the cylinder head 8 by a plurality of bolts 87.

As can be seen from FIG. 3, the first intake pipe 83*a* which is first from above extends substantially horizontally along a lower surface of the lower belt cover 10, but the second to fourth intake pipes 83*b*, 83*c* and 83*d* which are second, third and fourth from above are inclined upwards in a forward direction from the mounting flange 84 toward the surge tank 82. The inclination angle of the fourth intake pipe 83*d* is large; the inclination angle of the third intake pipe 83*c* is medium, and the inclination angle of the second intake pipe 83*b* is small. By disposing the intake pipes 83*b*, 83*c* and 83*d* in the inclined states in the above manner, that of fuel blown back from fuel injection valves 94 (which will be described hereinafter) which remains into the intake pipes 83*b*, 83*c* and 83*d* can immediately be returned into the cylinders 12 by the gravity, and moreover, a space can be ensured below the surge tank 82 and the fourth intake pipe 83*d*, and a high-pressure fuel supplying means which will be described hereinafter can be disposed in this space.

The lengths of the intake pipes 83*a*, 83*b*, 83*c* and 83*d* exert a large influence to the output from the engine E under a pulsating effect of the intake system. However, if the inclination angles of the intake pipes 83*a*, 83*b*, 83*c* and 83*d* are different from one another as described above, the length of the horizontal first intake pipe 83*a* is the shortest, and the length of the fourth intake pipe 83*d* having the large inclination angle is the largest. Therefore, in this embodiment, dispersion of the lengths of the intake pipes is compensated by offsetting the positions of connections at which upstream ends of the four intake pipes 83*a*, 83*b*, 83*c* and 83*d* are connected to the surge tank 82 with respect to the intake manifold mounting surface $8_1$ of the cylinder head 8 to which the mounting flange 84 at the downstream end is fixed, as shown in FIGS. 4 to 5D. More specifically, the offset amounts Da, Db, Dc and Dd of the first, second, third and fourth intake pipes 83*a*, 83*b*, 83*c* and 83*d* from the intake manifold mounting surface $8_1$ are set, so that the offset amount of the intake pipe is larger, as the inclination angle of the intake pipe is smaller, i.e., a relation, Da>Db>Dc>Dd is established.

Figure 5A:
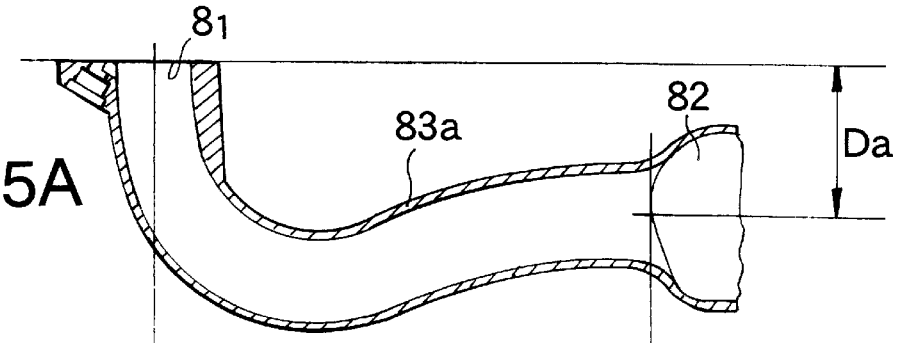
FIGS. 5A to 5D are diagrams showing shapes of intake pipes.
Figure 5B:
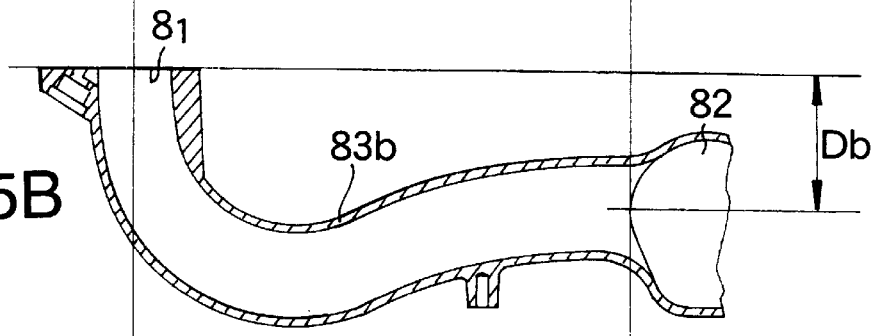
Figure 5C:
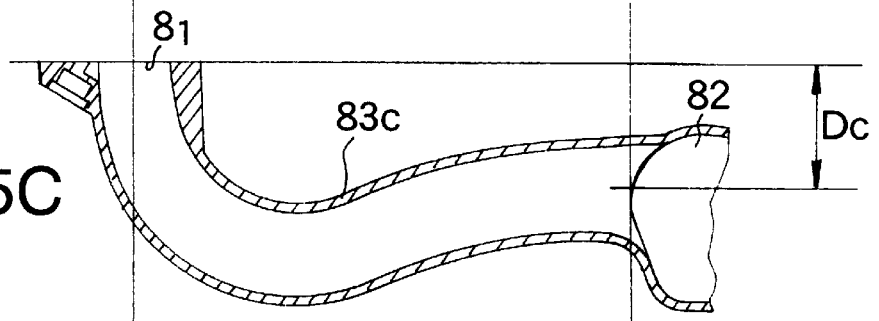
Figure 5D:
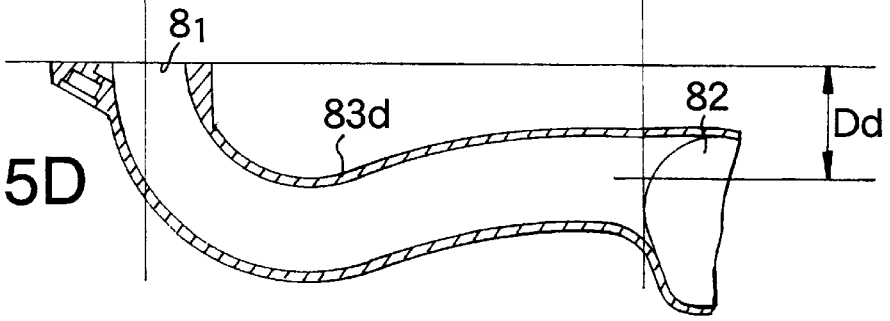
Figure 6:
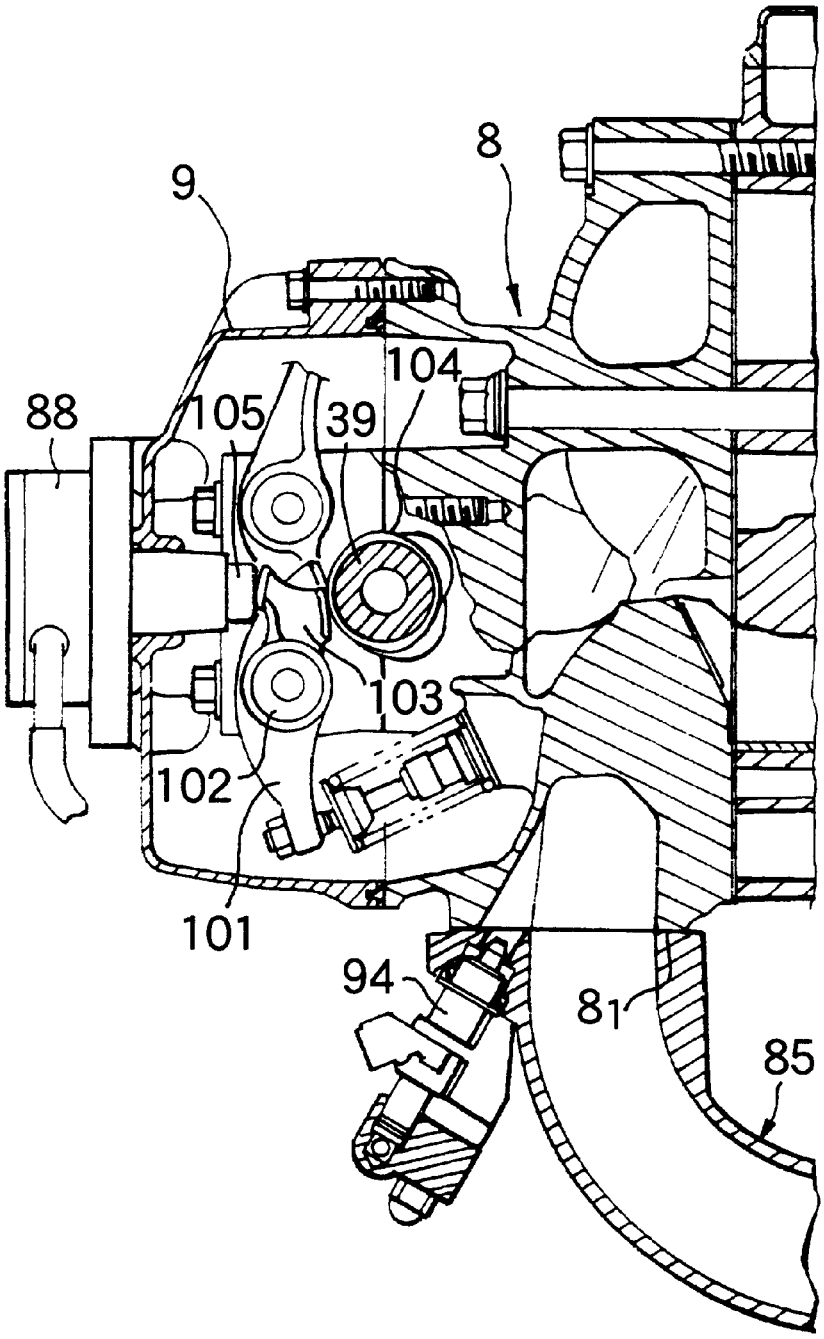

As a result, the decrement in length of the first intake pipe 83*a* shown in FIG. 5A due to the horizontal disposition thereof is compensated by the large offset amount Da, and the increment in length of the fourth intake pipe 83*d* shown in FIG. 5D due to the disposition thereof in the largely inclined state is compensated by the small offset amount Dd, whereby the lengths of the four intake pipes 83*a*, 83*b*, 83*c* and 83*d* can substantially be equalized to one another. By eliminating the dispersion of the lengths of the four intake pipes 83*a*, 83*b*, 83*c* and 83*d* in the above manner, a reduction in output from the engine E can be prevented.

The structure of a fuel supply system in the engine E will be described below with reference to FIGS. 2 to 4, 6 and 7.

Two low-pressure fuel pumps 88, 88 each comprising a plunger pump are mounted in parallel on a rear surface of the head cover 9, so that the fuel drawn from a fuel tank (not shown) mounted within a boat through a fuel supplying pipe $L_1$ is supplied by the low-pressure fuel pumps 88, 88 through a fuel supplying pipe $L_2$ into a subsidiary tank 89 mounted on a right side of the cylinder block 6. As can be seen from FIG. 6, a pump driving rocker arm 103 is coaxially supported on an intake rocker arm shaft 102 supporting an intake rocker arm 101 thereon, so that one end of the pump driving rocker arm 103 abuts against a pump cam 104 provided on the cam shaft 39, while the other end abuts against a plunger 105 of the low-pressure fuel pumps 88, 88, whereby the low-pressure fuel pumps 88, 88 are driven by the cam shaft 39.

Figure 7:
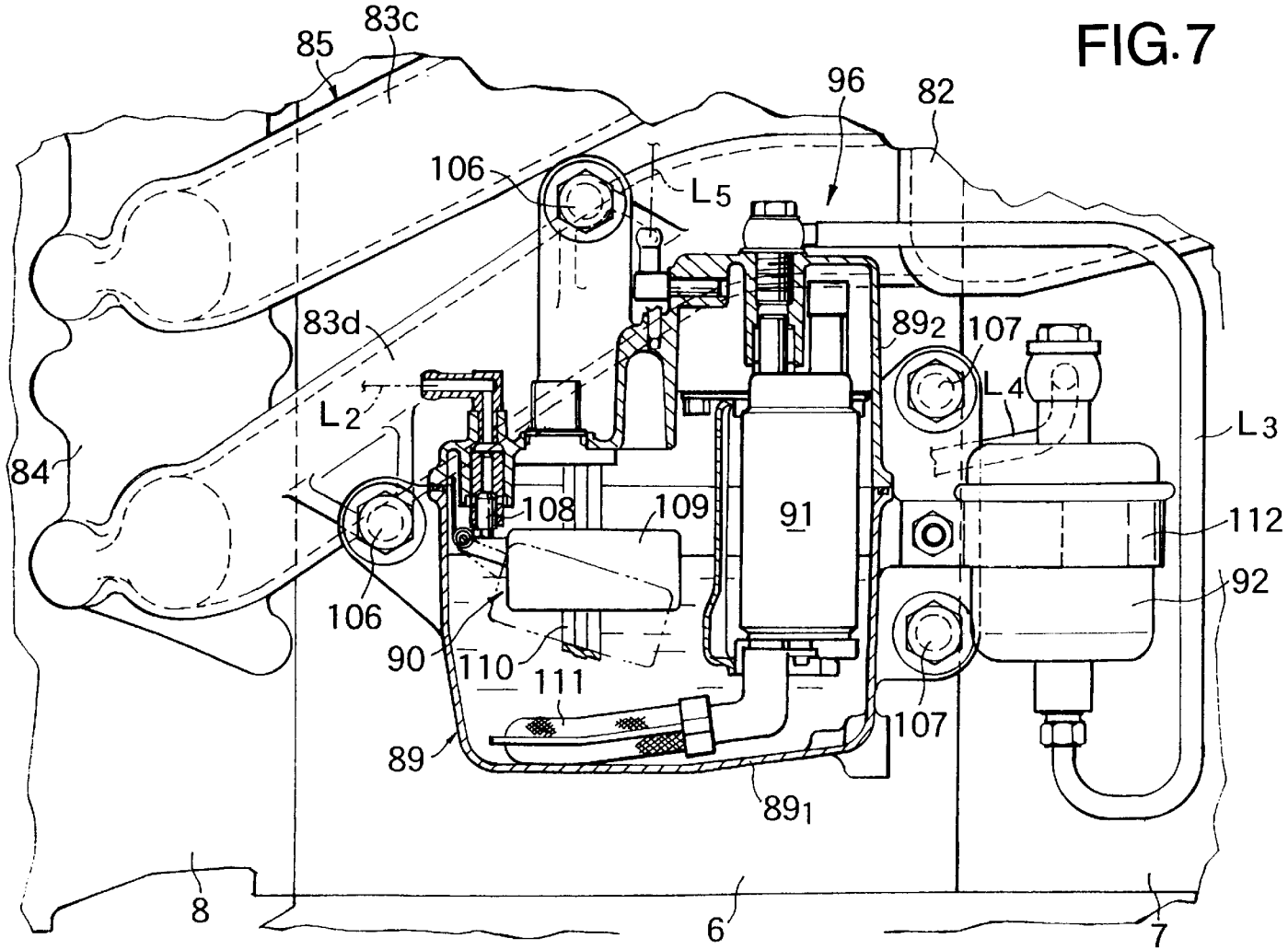

As can be seen from FIGS. 3 and 7, the subsidiary tank 89 is divided into two portions: a lower-side body portion $89_1$ and an upper-side cap $89_2$. The body portion $89_1$ is fixed to two bosses formed on the fourth intake pipe 83*d* by bolts 106, 106 and fixed to the cylinder block 6 by two bolts 107, 107. A float valve 90 for regulating the fuel level and a high-pressure fuel pump 91 comprising an electromagnetic pump are accommodated within the subsidiary tank 89.

The float valve 90 comprises an on-off valve 108 mounted at a location where the fuel supplying pipe $L_2$ extending from the low-pressure fuel pumps 88, 88 is connected to the subsidiary tank 89, a float 109 for moving upward and downward following the fuel level and for opening and closing the on-off valve 108, and a guide member 110 for guiding the upward and downward movements of the float 109. The float valve 90 is adapted to open the on-off valve 108 to introduce the fuel from the low-pressure pumps 88, 88 into the subsidiary tank 89, when the fuel level is lowered, and to close the on-off valve 108 to block the reception of the fuel from the low-pressure pumps 88, 88, when the fuel level is raised. The high-pressure pump 91 is disposed vertically and adapted to pump the fuel drawn from a strainer 111 disposed to extend along a bottom wall of the subsidiary tank 89, through a fuel supplying pipe $L_3$ into a high-pressure filter 92 which is fixed to a front portion of the subsidiary tank 89 by a band 112.

A fuel rail 93 is fixed to the mounting flange 84 of the intake manifold 85 by a plurality of bolts 113, and four fuel injection valves 94 corresponding to the four cylinders 12 are fixed to the mounting flange 84, so that the fuel supplied from the high-pressure filter 92 through a fuel supplying pipe $L_4$ to a lower end of the fuel rail 93 is distributed to the four fuel injection valves 94. A regulator 95 is mounted as a surplus fuel feeding-back means at an upper end of the fuel rail 93 and adapted to regulate the pressure of the fuel supplied to the fuel injection valves 94 and to return a surplus amount of the fuel to the subsidiary tank 89 through a fuel returning pipe $L_5$. To regulate the preset pressure in the regulator 95, the regulator 95 and the surge tank 82 are interconnected through a negative pressure pipe $L_6$.

The subsidiary tank 89, the high-pressure fuel pump 91, the high-pressure filter 92, the fuel rail 93 and the regulator 95 form a high-pressure fuel supply means 96. As can be seen from FIG. 2, the intake manifold 85 and the high-pressure fuel supply means 96 are disposed along a right side of the cylinder block 6, and an electric equipment box 97 is disposed along a left side of the cylinder block 6. By disposing the intake manifold 85 as well as the high-pressure fuel supply means 96 and the electric box 97 in a distributed manner on the left and right of the cylinder axis, as described above, an internal space in the engine room 36 can be effectively utilized to make the outboard engine system O compact. A reference character 98 in FIGS. 3 and 4 denotes a cartridge-type oil filter.

When the engine E is to be assembled, the high-pressure fuel supplying means 96 is previously assembled to the intake manifold 85 to form a subassembly, whereby the number of assembling steps can be decreased to enhance the workability. More specifically, the subsidiary tank 89 having the float valve 90 and the high-pressure fuel pump 91 incorporated therein is fixed by the two bolts 106, 106 to the third and fourth intake pipes 83*c* and 83*d* of the intake manifold 85 having the fuel injection valves 94 mounted to the mounting flange 84 and further, the high-pressure filter 92 is fixed to the subsidiary tank 89 using the band 112. The fuel rail 93 connecting the four fuel injection valves 94 together is fixed to the mounting flange 84 of the intake manifold 85 by the bolts 113, and the regulator 95 is fixed to the fuel rail 93.

Then, one end of the fuel supplying pipe $L_2$ is connected to the float valve 90 of the subsidiary tank 89. The high-pressure fuel pump 91 of the subsidiary tank 89 and the high-pressure filter 82 are interconnected by the fuel supplying pipe $L_3$, and the high-pressure filter 82 and the lower end of the fuel rail 93 are interconnected by the fuel supplying pipe $L_4$. In addition, the regulator 95 and the subsidiary tank 89 are interconnected by the fuel returning pipe $L_5$ and further, the regulator 95 and the surge tank 82 are interconnected by the negative pressure pipe $L_6$. Thus, if the high-pressure fuel supplying means 96 and the intake manifold 85 are previously assembled as the subassembly, the assembling can be completed only by fixing the intake manifold 85 to the cylinder head 8 by the plurality of bolts 87 and fixing the subsidiary tank 89 to the cylinder block 6 by the two bolts 107, 107 and then, connecting the other end of the fuel supplying pipe $L_2$ to the low-pressure fuel pumps 88. By previously assembling the high-pressure fuel supplying means 96 to the intake manifold 85 to form the subassembly in the above manner, the number of assembling steps can be remarkably decreased.

Figure 8:
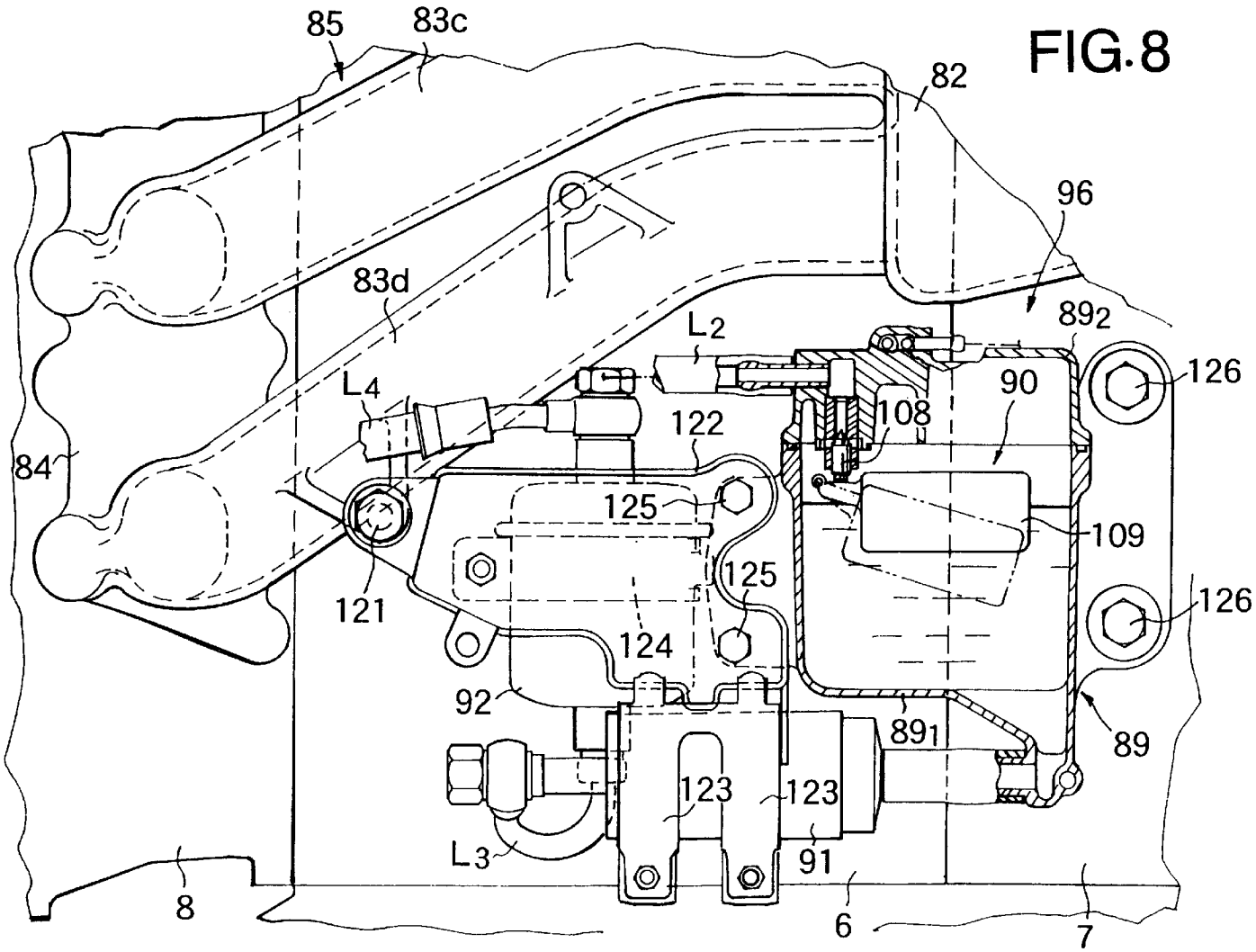
FIG. 8 is a view similar to FIG. 7, but according to a second embodiment of the present invention.

A second embodiment of the present invention will now be described with reference to FIG. 8.

The second embodiment is different from the first embodiment in respect of the structure of the high-pressure fuel supply means 96. More specifically, the high-pressure fuel supply means 96 in the second embodiment includes a bracket 122 fixed to the fourth intake pipe 83*d* by a bolt 121. The high-pressure fuel pump 91 and the high-pressure filter 92 are fixed to the bracket 122 by bands 123, 123, 124, respectively. The subsidiary tank 89 including the float valve 90 therein is fixed at its rear end to a front end of the bracket 122 by two bolts 125, 125, and at its front end to the crankcase 7 by two bolts 126, 126. Therefore, the subsidiary tank 89, the high-pressure fuel pump 91 and the high-pressure filter 92 can be previously assembled to the intake manifold 85 to form a subassembly, thereby reducing the number of assembling steps.

In the first embodiment, the high-pressure fuel pump 91 and the subsidiary tank 89 can be formed integrally with each other to further reduce the number of assembling steps by accommodating the high-pressure fuel pump 91 within the subsidiary tank 89. In the second embodiment, the high-pressure fuel pump 91 can be disposed outside the subsidiary tank 89 to facilitate the maintenance.

Although the embodiments of the present invention has been described in detail, it will be understood that the present invention is not limited to the above-described embodiments, and various modifications in design may be made without departing the subject matter of the present invention.

For example, the engine E of the outboard engine system O has been illustrated in the embodiments, but the present invention is applicable to an engine used in an application other than the outboard engine system O.

What is claimed is:

1. A fuel supply structure in a 4-cycle engine having a cylinder block, a cylinder head and an intake manifold, said intake manifold being fixed to said cylinder head and is disposed to extend along a side of the engine, in which said structure is comprised of a high-pressure fuel supply means which is provided on said side of the engine and includes a subsidiary tank for temporarily storing fuel to be supplied to a fuel injection valve, said high-pressure fuel supply means being mounted to an intake pipe of said intake manifold, said intake pipe extending sidewardly of said cylinder block in a longitudinal direction of the engine.

2. A fuel supply structure in an engine according to claim 1, characterized in that said high-pressure fuel supply means (96) includes a high-pressure fuel pump (91).

3. A fuel supply structure in an engine according to claim 2, characterized in that said high-pressure fuel pump (91) is accommodated in said subsidiary tank (89).

4. A fuel supply structure in an engine according to claim 2, characterized in that said high-pressure fuel pump (91) is mounted to said intake system (85).

5. A fuel supply structure in an engine according to claim 1, characterized in that said high-pressure fuel supply means (96) includes a surplus fuel returning means (95) for returning a surplus fuel from said fuel injection valve (94) to said subsidiary tank (89).

6. A fuel supply structure in an engine according to claim 1, characterized in that said intake system (85) includes a surge tank (82) and an intake pipe (83*a*, 83*b*, 83*c* and 83*d*), and said high-pressure fuel supply means (96) is mounted to said intake pipe (83*a*, 83*b*, 83*c* and 83*d*).

7. A fuel supply structure in an engine according to claim 3, characterized in that said high-pressure fuel supply means (96) includes a high-pressure filter (92) mounted to said subsidiary tank (89).

8. A fuel supply structure in an engine according to claim 4, characterized in that said high-pressure fuel supply means (96) includes a high-pressure filter (92), and said high-pressure filter (92) and said high-pressure fuel pump (91) are mounted to said intake system (85) through a bracket (122).

9. A fuel supply structure in an engine according to claim 1, characterized in that said intake system (85) is disposed on one side of a cylinder axis, and an electric equipment box (97) is disposed on the other side of the cylinder axis.

* * * * *